US007162167B2

(12) United States Patent
Iida et al.

(10) Patent No.: US 7,162,167 B2
(45) Date of Patent: Jan. 9, 2007

(54) IMAGE FORMING APPARATUS, METHOD OF ADJUSTING DEVELOPING UNIT OF THE APPARATUS, DEVELOPING UNIT, AND STORAGE MEDIUM

(75) Inventors: Kenichi Iida, Boise, ID (US); Masao Uyama, Shizuoka (JP); Masahide Kinoshita, Shizuoka (JP); Motoki Adachi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 10/807,319

(22) Filed: Mar. 24, 2004

(65) Prior Publication Data

US 2004/0228642 A1 Nov. 18, 2004

(30) Foreign Application Priority Data

Mar. 28, 2003 (JP) ..... 2003-092825

(51) Int. Cl.
*G03G 15/08* (2006.01)

(52) U.S. Cl. ..... 399/27; 399/30

(58) Field of Classification Search ..... 399/27, 399/30, 106, 28, 29, 61, 62; 247/228, 140
See application file for complete search history.

(56) References Cited

U.S. PATENT DOCUMENTS 5,091,749 A * 2/1992 Iida et al. ..... 399/59
6,219,496 B1 * 4/2001 Kojima et al. ..... 399/43
6,226,025 B1 * 5/2001 Kim ..... 347/228
6,381,419 B1 4/2002 Kinoshita et al. ..... 399/27
6,553,191 B1 * 4/2003 Nakane ..... 399/38
6,640,060 B1 10/2003 Yamaguchi et al. ..... 399/27

FOREIGN PATENT DOCUMENTS

JP 2001-194859 7/2001
JP 2001-194909 7/2001
JP 3426148 * 7/2003

* cited by examiner

*Primary Examiner*—Brij B. Shrivastav
(74) *Attorney, Agent, or Firm*—Fitzpatrick, Cella, Harper & Scinto

(57) ABSTRACT

In adjustment control of a developing device, the number of printed sheets and the toner consumption amount per sheet are calculated. If the accumulated toner consumption amount is smaller than a predetermined amount when a predetermined number of sheets are printed, the developing device is caused to supply a developer in a predetermined amount corresponding to the difference, thereby performing development adjustment of the developing device.

27 Claims, 10 Drawing Sheets

FIG. 4

| ENVIRONMENT/ CONDITIONS OF USAGE | 0% | 25% | 50% | 75% | 100% |
|---|---|---|---|---|---|
| 15°C · 10%Rh | 5.06 [mg] | 4.55 [mg] | 4.05 [mg] | 3.54 [mg] | 3.04 [mg] |
| 23°C · 60%Rh | 4.05 [mg] | 3.54 [mg] | 3.04 [mg] | 2.53 [mg] | 2.03 [mg] |
| 30°C · 80%Rh | 3.04 [mg] | 2.53 [mg] | 2.03 [mg] | 1.52 [mg] | 1.02 [mg] |

FIG. 5

| | |
|---|---|
| Y DEVELOPING DEVICE | 4.55 [mg] |
| M DEVELOPING DEVICE | 4.05 [mg] |
| C DEVELOPING DEVICE | 4.05 [mg] |
| K DEVELOPING DEVICE | 3.54 [mg] |

FIG. 7

| ENVIRONMENT/ CONDITIONS OF USAGE | 0% | 25% | 50% | 75% | 100% |
|---|---|---|---|---|---|
| 15°C · 10%Rh | 263 [mg] | 253 [mg] | 243 [mg] | 233 [mg] | 223 [mg] |
| 23°C · 60%Rh | 243 [mg] | 233 [mg] | 223 [mg] | 213 [mg] | 203 [mg] |
| 30°C · 80%Rh | 223 [mg] | 213 [mg] | 203 [mg] | 193 [mg] | 183 [mg] |

FIG. 8

| | |
|---|---|
| Y DEVELOPING DEVICE | 253 [mg] |
| M DEVELOPING DEVICE | 243 [mg] |
| C DEVELOPING DEVICE | 243 [mg] |
| K DEVELOPING DEVICE | 233 [mg] |

IMAGE FORMING APPARATUS, METHOD OF ADJUSTING DEVELOPING UNIT OF THE APPARATUS, DEVELOPING UNIT, AND STORAGE MEDIUM

FIELD OF THE INVENTION

The present invention relates to an image forming apparatus for forming an image by transferring a developer image (toner image), formed on an image carrier by an electrophotographic method or the like, onto a transfer material, a method of adjusting a developing unit of the apparatus, the developing unit, and a storage medium.

BACKGROUND OF THE INVENTION

In an image forming apparatus which prints an image by transferring a developer image (toner image), formed on the surface of a photosensitive drum as an image carrier, onto a transfer material such as a paper sheet which is a transfer medium (printing medium), the transfer material is passed through a transfer portion formed in a contact portion between the photosensitive drum and a transfer member such as a transfer roller urged against the photosensitive drum. A voltage is applied to the transfer member in synchronism with the timing of the passage, and the toner image on the surface of the photosensitive drum is transferred onto the transfer material by the action of the electric field formed by the voltage. An image forming apparatus of this type has been put into practical use.

Also, with the recent progress of an information-oriented society, the needs for color printers are increasing, and an inline type of printer is attracting attention. In this inline type of printer, a plurality of image carriers corresponding to different colors are arranged in a line in order to increase the color image output speed. The inline type of printer forms toner images of these different colors in turn by using the individual image carriers, and transfers the toner images onto a transfer material directly or via an intermediate transfer member.

In the conventional printers as described above, when a user is continuously printing images having a low printing ratio (a low pixel ratio per page) over a long time, deterioration of toner progresses as the number of printed sheets increases, and the amount of high-triboelectrification toner which is charged up more strongly than normal toner increases in a developing device. This is so because the toner in the developing device stays in it for long time periods while the toner repetitively undergoes triboelectrification by a developing sleeve (developing roller) or by an elastic blade in contact with the sleeve. This strongly charged toner increases its electrical adhesion to individual members, and therefore worsens the properties of development onto the photosensitive drum or the properties of transfer onto the intermediate transfer belt or transfer material. This decreases the density of solid images and the like.

In this strongly charged toner, the electrical repulsion force between toner particles also increases. This deteriorates the image quality by scattering and the like when line images or characters are transferred. For example, images are recently often printed on glossy paper and the like especially in color machines. In a case like this, the image quality is increased by increasing the glossiness of images by lowering the fixing speed of the apparatus. Since glossy paper has improved toner fixing properties, the area of spread toner increases. If line images or characters scatter, therefore, this scattering is conspicuous on glossy paper, although it may be inconspicuous on plain paper. In addition, a high whiteness of glossy paper makes scattering conspicuous, and this increases the thicknesses of line images and characters and spreads thin lines, thereby deteriorating the image quality. These phenomena are particularly notable after images are continuously printed in a low-temperature, low-humidity environment.

In contrast, when a user is continuously printing images having a high printing ratio over a long time by using the conventional printer described above, deterioration of toner progresses as the number of printed sheets increases. Consequently, the amount of low-triboelectrification toner which is charged up more weakly than normal toner or the amount of reverse-polarity-triboelectrification toner which is charged up to the polarity reverse to that of normal toner increases in the developing device. This is so because the toner in the developing device is successively discharged outside the developing device without being much affected by triboelectrification by the developing sleeve or by the elastic blade in contact with the sleeve. This weakly charged toner or reverse-polarity toner reduces the electrical adhesion to the developing sleeve, and hence excessively raises the properties of development onto the photosensitive drum, thereby raising the density of solid images and the like. In addition, the weakly charged toner or reverse-polarity toner worsens a so-called fogging phenomenon in which thin toner is developed in a non-image portion on the photosensitive drum. This phenomenon is also conspicuous when images are printed on aforementioned glossy paper and the like. These phenomena are particularly notable after images are printed in a high-temperature, high-humidity environment.

To prevent the image deterioration and fogging phenomenon as described above, so-called developing device adjustment control is executed in various types of printers. For example, at every printing timing except for a printing operation, the high-triboelectrification toner is discharged from the developing sleeve (developing roller) and its vicinity in the developing device by developing the toner as a toner image such as a solid image on the photosensitive drum. Alternatively, the low-triboelectrification toner or reverse-polarity toner is agitated in the developing device by idling the developing sleeve (developing roller). When a control like this is executed, images can be printed by readjusting the average triboelectrification of the toner in the developing device to a preferred charge amount. Accordingly, various defective images caused by the developing device can be eliminated.

Note that the control for idling the developing sleeve (developing roller) is to idle the developing sleeve in a state in which no bias is applied to the developing device; in a state in which although a bias is applied to the developing device, the developing device is set at a potential equal to the potential on the photosensitive drum so that no toner is developed on the surface of the photosensitive drum; or in a state in which the developing sleeve is separated from the photosensitive drum in an arrangement in which the developing device and photosensitive drum can be separated.

Unfortunately, the developing device adjustment control described above poses new problems if the toner amount discharged from the developing device is not properly set. That is, in the conventional developing device adjustment control, the discharged toner amount is always set at a predetermined value regardless of the print log of the printer, in order to simplify the control. For example, if the discharged toner amount is small and insufficient, the average triboelectrification of the toner in the developing device cannot be readjusted to the preferred charge amount. Therefore, even after the developing device adjustment control is executed, the decrease in density of solid images or the deterioration of image quality of line images or characters continuously occurs. On the other hand, if the discharged toner amount is excessively large, the consumption of the toner in the developing device is accelerated, and this increases the running cost when the user uses the printer.

The above developing device adjustment control also poses new problems if the developing device idling time is not properly set. That is, in the conventional developing device adjustment control, the idling time is always set at a predetermined time regardless of the print log of the printer, in order to simplify the control. For example, if the idling time is short and insufficient, the average triboelectrification of the toner in the developing device cannot be readjusted to the preferred charge amount. Therefore, even after the developing device adjustment control is executed, the increase in density of solid images or fogging continuously occurs. On the other hand, if the idling time is excessively long, the downtime of the printer increases, and this decreases the throughput of the printer.

SUMMARY OF THE INVENTION

The present invention has been made in consideration of the above prior art, and has as its feature to provide an image forming apparatus and developing unit capable of effectively preventing a decrease in density of an image and deterioration of the image quality, a method of adjusting the developing unit, and a storage medium.

It is another feature of the present invention to provide an image forming apparatus capable of effectively preventing a decrease in density of solid images and the like and deterioration of the image quality of line images and characters, and also capable of suppressing a decrease in throughput, even when images having a low pixel ratio are continuously formed over a long time, and to provide a method of adjusting a developing unit of the apparatus.

It is still another feature of the present invention to provide an image forming apparatus capable of effectively preventing an increase in density of solid images and the like and fogging, and also capable of suppressing a decrease in throughput, even when images having a high pixel ratio are continuously formed over a long time, and to provide a method of adjusting a developing unit of the apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 depicts a view showing examples of toner consumption amount threshold values r [mg] set in various environments and use conditions in the second embodiment of the present invention;

FIG. 5 depicts a view showing examples of toner consumption amount threshold values r [mg] set in developing devices of different colors in the third embodiment of the present invention;

FIG. 7 depicts a view showing examples of toner consumption amount threshold values r' [mg] set in various environments and use conditions in the fifth embodiment of the present invention;

FIG. 8 depicts a view showing examples of toner consumption amount threshold values r' [mg] set in developing devices of different colors in the sixth embodiment of the present invention;

DETAILED DESCRIPTION OF THE PREFERRED EMBODIMENTS

Preferred embodiments of the present invention will now be described in detail in accordance with the accompanying drawings.

Figure 1:
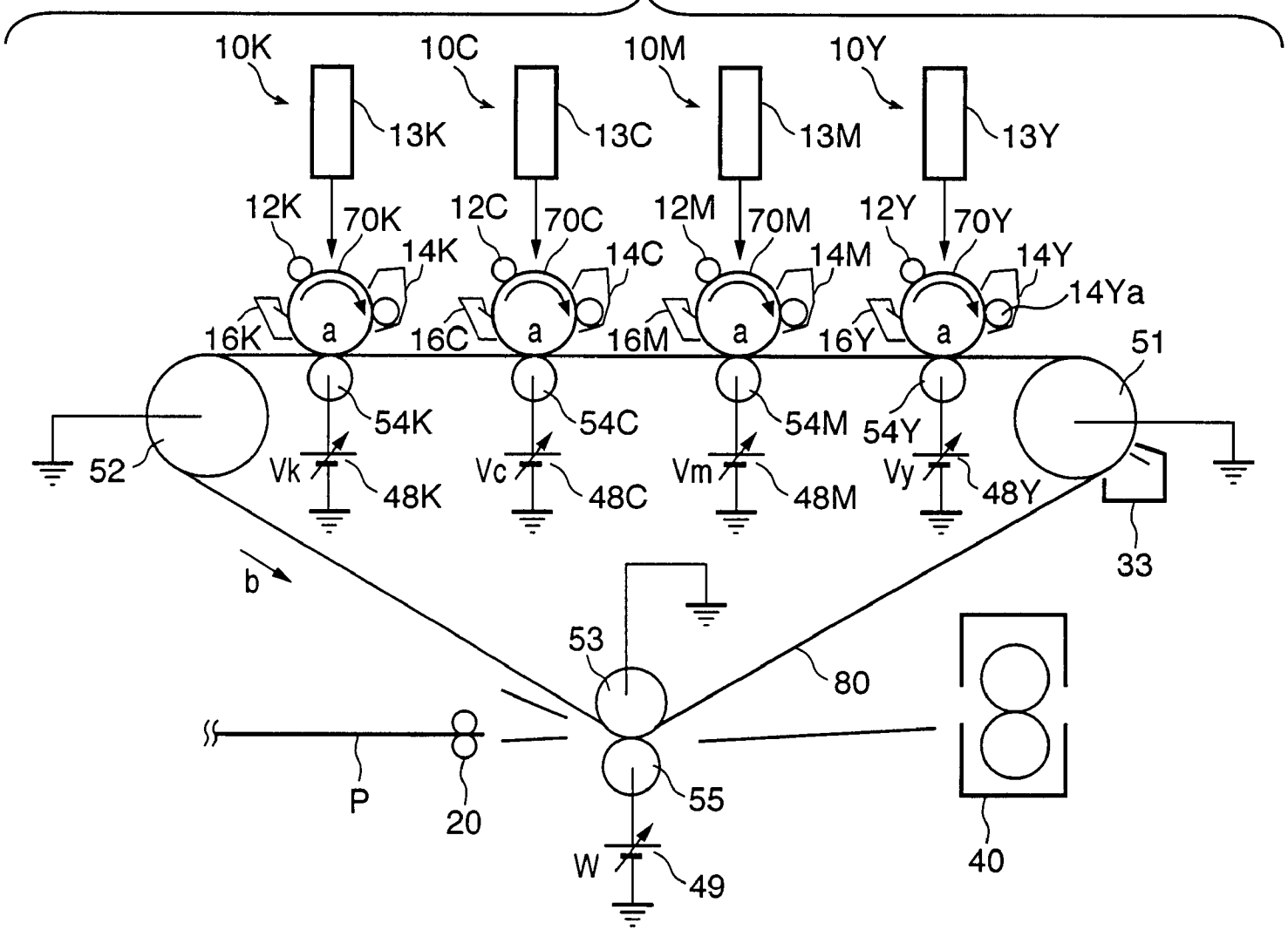
FIG. 1 depicts a view showing the arrangement of a printer engine of a laser beam printer according to an embodiment of the present invention.

FIG. 1 depicts a schematic view showing the arrangement of a printer engine of a printer (laser beam printer) according to an embodiment of the present invention. This laser beam printer is a four-drum, intermediate transfer type of full-color printer.

Referring to FIG. 1, the laser beam printer has image forming units (image forming stations 10) 10Y, 10M, 10C, and 10K of four colors, i.e., yellow (Y), magenta (M), cyan (C), and black (K). The laser beam printer also has a transfer device including an intermediate transfer belt 80 as an intermediate transfer member, and a fixing device 40.

The image forming stations 10Y, 10M, 10C, and 10K are image forming units in which photosensitive drums (drum-like electrophotographic photosensitive members) 70Y, 70M, 70C, and 70K as image carriers are arranged in this order from the upstream side to the downstream side in the moving direction (indicated by an arrow b) of the intermediate transfer belt 80. Each photosensitive drum is rotatable in the direction indicated by an arrow a. On the outer circumferential surfaces of the photosensitive drums 70Y, 70M, 70C, and 70K, primary charging rollers 12Y, 12M, 12C, and 12K are arranged to evenly charge the surfaces of these photosensitive drums. On the downstream side, when viewed from these charging rollers 12Y, 12M, 12C and 12K, in the rotating direction of the photosensitive drums, laser exposing devices 13Y, 13M, 13C, and 13K are arranged to expose the photosensitive drum surfaces with laser beams modulated in accordance with image signals, respectively. On the downstream side of these laser exposing devices, developing devices 14 (14Y, 14M, 14C, and 14K) are respectively arranged to develop electrostatic latent images of different colors, formed on the photosensitive drum surfaces by laser exposure, by using toner components of the corresponding colors, i.e., yellow, magenta, cyan, and black.

Each of the developing devices 14Y, 14M, 14C, and 14K contains toner of a corresponding color, and supplies this color toner to the drum by rotating an internal roller. The developing device 14 (14Y–14K) is a unit of at least a toner container and a roller (a developing roller (sleeve), e.g., a developing roller 14Ya in the image forming station 10Y), and is detachable from the printer main body.

In positions (transfer positions) on the other side of the intermediate transfer belt 80, primary transfer rollers 54Y, 54M, 54C, and 54K oppose the photosensitive drums 70Y, 70M, 70C, and 70K, respectively, to form primary transfer portions together with these photosensitive drums. Primary transfer power supplies 48Y, 48M, 48C, and 48K are connected to the primary transfer rollers 54Y, 54M, 54C, and 54K, respectively, and apply primary transfer voltages Vy, Vm, Vc, and Vk, respectively.

The intermediate transfer belt 80 is looped between three rollers, i.e., a driving roller 51, tension roller 52, and secondary transfer counter roller 53, and brought into contact with the photosensitive drums 70Y to 70K through the image forming stations 10Y to 10K. The intermediate transfer belt 80 is rotated in the direction of the arrow b shown in FIG. 1 by the driving roller 51. On the surfaces of the photosensitive drums 70Y, 70M, 70C, and 70K, drum cleaners 16Y, 16M, 16C, and 16K for removing untransferred toner remaining on these drum surfaces are arranged downstream of the primary transfer rollers 54Y, 54M, 54C, and 54K, respectively. Also, the driving roller 51 of the intermediate transfer belt 80 has a belt cleaner 33 for removing untransferred residual toner sticking to the surface of the intermediate transfer belt 80.

The image forming operation of the laser beam printer having the above arrangement will be described below by taking the yellow image forming station 10Y as an example. Since the operations of other image forming stations 10M–10K are substantially the same as that of the yellow image forming station 10Y, the explanations of them are omitted.

The photosensitive drum 70Y of the yellow station 10Y is constructed by forming a photoconductive layer on the surface of an aluminum cylinder. During the course of rotation in the direction of the arrow a, the primary charging roller 12Y evenly charges the surface of the drum 70Y to negative charge (charging potential =−600 V), and the laser exposing device 13Y exposes an image in accordance with a Y image signal (surface potential after exposure=−200 V), thereby forming an electrostatic latent image corresponding to the yellow image on the surface of the photosensitive drum 70Y. This electrostatic latent image is developed by the developing device 14Y by using negatively charged yellow toner, and thereby visualized as a yellow toner image on the drum 70Y.

The yellow toner image thus obtained is primarily transferred onto the intermediate transfer belt 80 by applying the primary transfer voltage from the primary transfer power supply 48Y to the primary transfer roller 54Y. The drum cleaner 16Y removes untransferred residual toner sticking to the surface of the photosensitive drum 70Y after transfer, and the next image formation is performed.

The above image forming operation is performed at predetermined timings in the image forming stations 10Y to 10K, and the toner images on the photosensitive drums 70Y to 70K are primarily transferred and overlapped in turn on the intermediate transfer belt 80 in the individual primary transfer portions. In a full-color mode, toner images are transferred and overlapped on the intermediate transfer belt 80 in the order of yellow, magenta, cyan, and black. In a monochrome mode or in a two- or three-color mode, toner images of necessary colors are transferred in the same order as above.

After that, by the rotation in the direction of the arrow b of the intermediate transfer belt 80, the toner images of the four colors formed on the intermediate transfer belt 80 are moved to a secondary transfer portion in which the secondary transfer roller 55 is pressed against the grounded secondary transfer counter roller 53 via the intermediate transfer belt 80. When a secondary transfer voltage W is applied from a secondary transfer power supply 49 to the secondary transfer roller 55, the toner images of the four colors on the intermediate transfer belt 80 are simultaneously secondarily transferred onto a transfer material P which is supplied at a predetermined timing by a paper feed roller 20.

The transfer material P on which the toner images of the four colors are thus secondarily transferred is conveyed to the fixing device 40 and pressed and heated in it. As a consequence, the toner components of the four colors are melted, mixed, and fixed on the transfer material P. In this manner, a full-color image is formed on the transfer material P. On the other hand, the belt cleaner 33 removes untransferred toner remaining on the surface of the intermediate transfer belt 80 after secondary transfer.

In this embodiment, negatively chargeable OPC drums 30.6 mm in diameter are used as the photosensitive drums 70 (70Y to 70K), and a charging voltage obtained by superposing an AC component on a DC component is applied to the primary charging rollers 12 (12Y to 12K), thereby evenly charging the surfaces of the photosensitive drums 70 to about −600 V regardless of the environment. Each of the laser exposing devices 13 (13Y to 13K) has a near infrared laser diode having a wavelength of 760 nm and a polygon mirror for scanning the photosensitive drum 70 with a laser beam, and lowers the surface potential of the photosensitive drum 70 to −200 V by exposure. In this way, an electrostatic latent image having this exposed portion charged to −200 V as an image portion is formed.

Each of the developing devices 14 (14Y to 14K) uses a developing method using nonmagnetic toner (a monocomponent nonmagnetic developer). As this nonmagnetic toner, polymerized toner 6 μm in particle diameter having a core/shell structure containing wax is used. This toner is carried on the surface of the developing sleeve with coating by using a coating roller, and conveyed to a developing portion opposite to the photosensitive drum 70 by the rotation of the developing sleeve while the toner layer thickness is regulated by an elastic blade. By applying a developing voltage, obtained by superposing an AC component on a DC component, to the developing sleeve, this toner on the developing sleeve is adhered to the exposed portion of the electrostatic latent image on a corresponding one of the photosensitive drums 70 (70Y to 70K), thereby reversely developing the latent image.

Each of the primary transfer rollers 54 (54Y to 54k) is given a diameter of 16 mm by covering a core metal 8 mm in diameter with an EPDM conductive rubber layer over 310 mm in the longitudinal direction. The individual core metals are connected to the primary transfer power supplies 48 (48Y to 48K) via power supply springs. The primary transfer roller 54 has an asker C hardness of 35°. The resistance of the primary transfer roller 54 is $1\times10^6$ Ω when this primary transfer roller is pressed, with a load of 500 g applied to its two ends, against an aluminum cylinder 30 mm in diameter rotated at a peripheral speed of 24 mm/sec, and a voltage of 50 V is applied between the cylinder and primary transfer roller.

The secondary transfer roller 55 is given a diameter of 17 mm by covering a core metal 8 mm in diameter with a urethane-based conductive rubber layer over 310 mm in the longitudinal direction. The asker C roller hardness is 30°, and the resistance is b $1\times10^7$ Ω when measured by the same method as the primary transfer roller. The core metal of the secondary transfer roller 55 is also connected to the high-voltage power supply 49 via a power supply spring. Each of the driving roller 51, tension roller 52, and secondary transfer counter roller 53 is an aluminum conductive roller 32 mm in diameter, and the core metal is grounded via a power supply spring.

The intermediate transfer belt 80 is a single-layered, seamless, endless belt made of a polyimide resin whose resistance is adjusted by carbon dispersion. The intermediate transfer belt 80 has a thickness of 75 μm, a circumferential length of 1,115 mm, and a width of 310 mm in a direction perpendicular to the circumferential direction. In accordance with JIS (Japanese Industrial Standard) –K6911, conductive rubber was used as an electrode in order to obtain a good contact between the electrode and belt surface, and the R8340 ultra-high resistance meter manufactured by Advantest was used to measure a volume resistivity ρv and surface resistivity ρs of the intermediate transfer belt 80. Consequently, $\rho v=5\times10^8$ Ωcm and $\rho s>1\times10^{13}$ [Ω/□] when 100 V were applied for 10 sec. Note that the values of ρs measured on the upper and lower surfaces of the belt 80 were the same.

The tension of the intermediate transfer belt 80 looped between the three rollers 51, 52, and 53 is 6 kgf. The distance between the driving roller 51 and tension roller 52 is 500 mm. The primary transfer portions formed by the photosensitive drums 70 (70Y to 70K) and primary transfer rollers 54 (54Y to 54K) of the image forming stations 10 (10Y to 10K) are equally spaced on the intermediate transfer belt 80. Each primary transfer roller 54 is raised by springs attached to the two ends of the roller and having a load of 500 gf, and is pushed against the lower surface of the intermediate transfer belt 80 by a force obtained by subtracting a weight of 150 g of the primary transfer roller 54 from 500 gf.

In the laser beam printer according to this embodiment, the maximum size of usable transfer materials is A3, and the process speed is 117 [mm/sec]. Note that when the primary transfer voltages Vy to Vk are 200 V and the secondary transfer voltage W is 2.3 kV, good transfer properties on plain paper are obtained for all colors.

Methods of detecting the number of printed sheets and the toner consumption amount during image formation and developing device adjustment control based on these pieces of information as the characteristic features of the laser beam printer according to this embodiment will be described below.

Note that operations such as detection, calculations, printing, and determination in the control according to this embodiment are executed by a CPU 110 (FIG. 2) of a printer controller 101. Note also that the storage medium of the present invention is equivalent to memories (e.g., a RAM 112 and program memory 111) of the printer controller 101.

Figure 2:
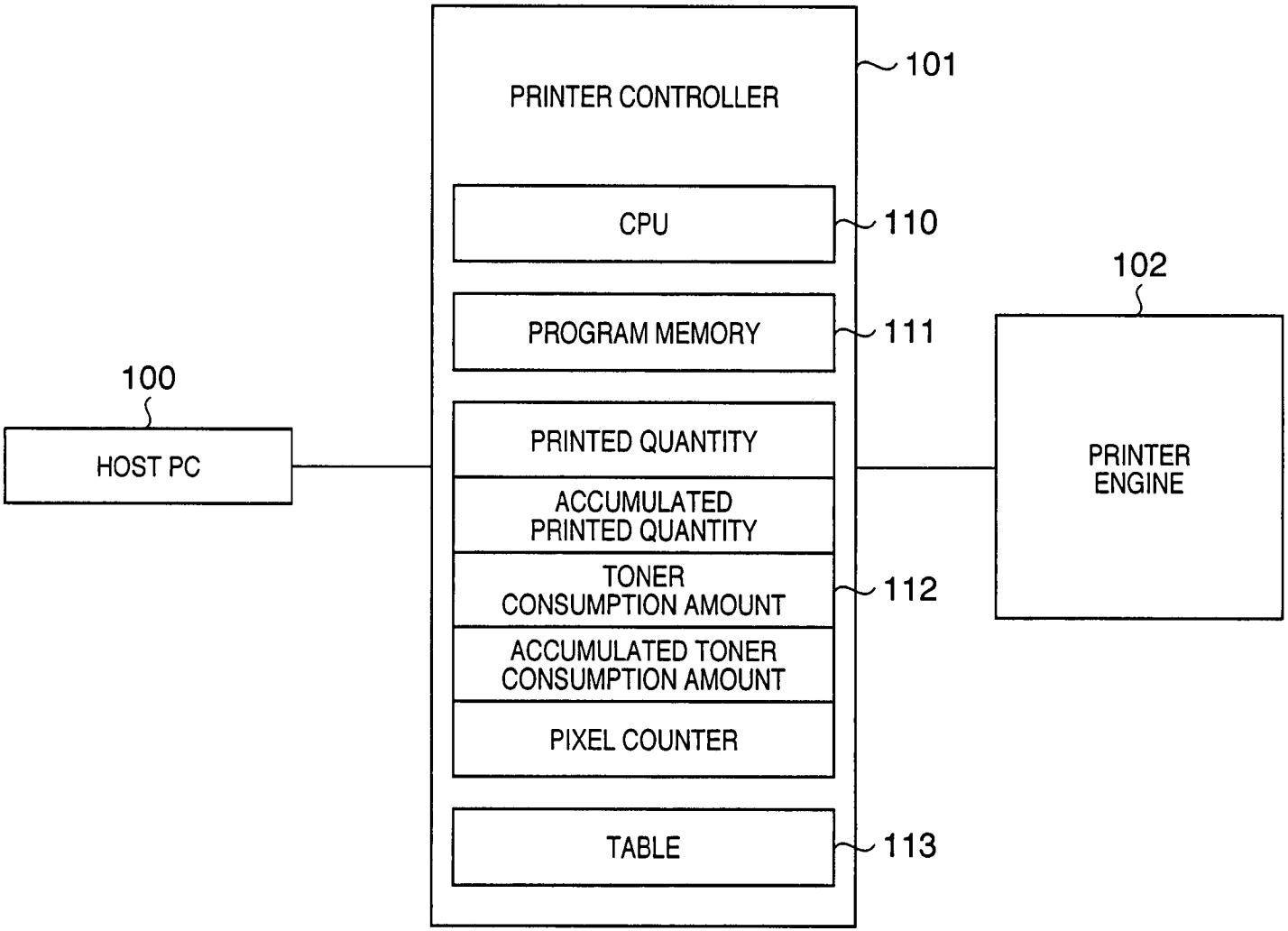
FIG. 2 is a block diagram showing an outline of the configuration of the laser beam printer according to the embodiment of the present invention.

FIG. 2 is a block diagram showing an outline of the configuration of the laser beam printer according to this embodiment.

Referring to FIG. 2, a host computer (PC) 100 has functions of an external apparatus for transmitting printing data to this printer to cause it to print the data. The printer controller 101 controls the operation of the whole printer. A printer engine 102 includes the photosensitive drums 70Y to 70K as shown in FIG. 1, and can form images in four colors, for example Y, M, C, and K.

The printer controller 101 includes the CPU 110, and the program memory 111 and RAM 112 storing programs to be executed by the CPU 110. The RAM 112 has a plurality of work areas for temporarily storing various data to be described later. A table 113 contains data as shown in FIGS. 4, 5, 7, and 8 to be described later.

Figure 3:
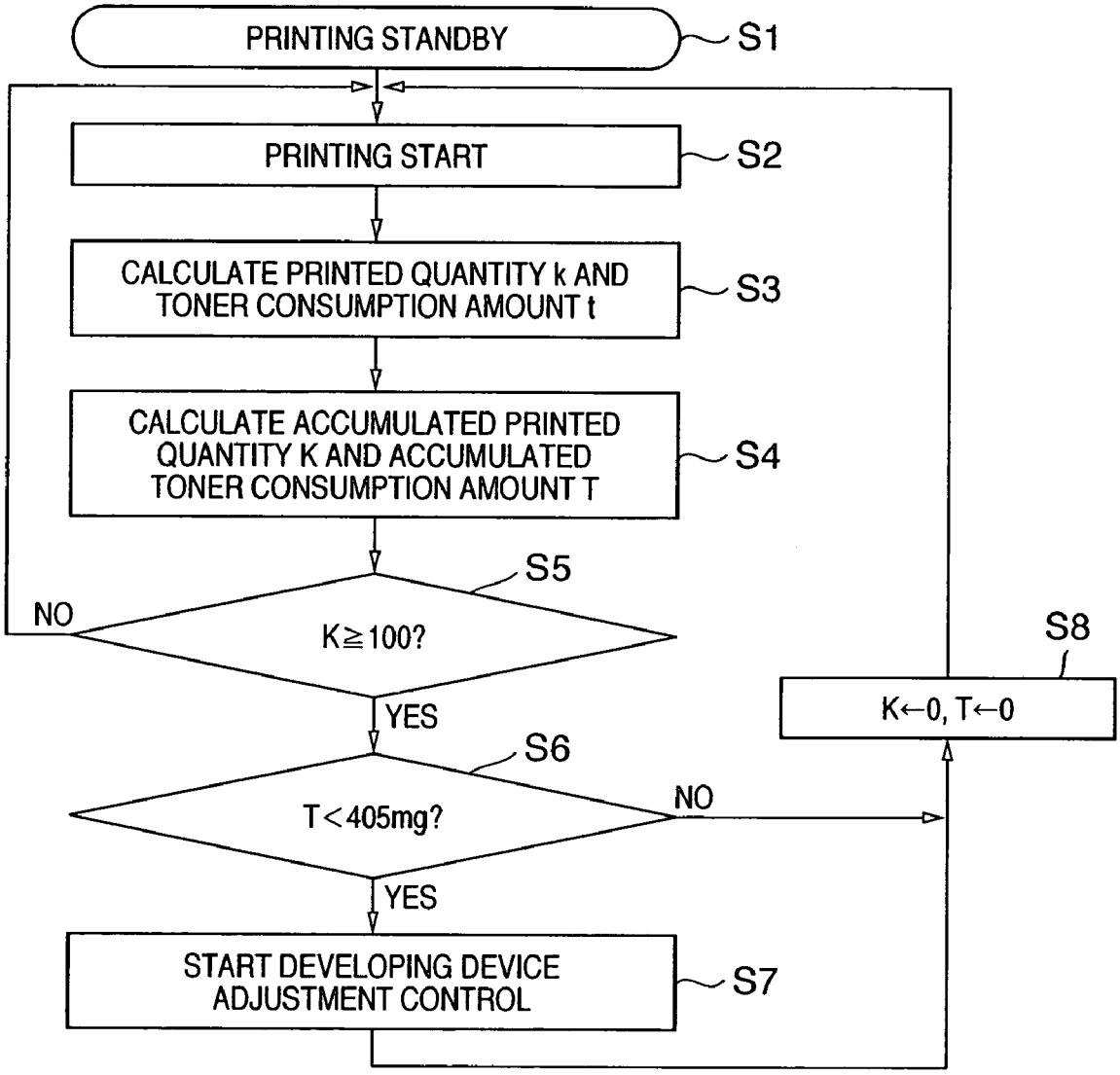
FIG. 3 is a flowchart for explaining a developing device adjustment control process in a laser beam printer according to the first embodiment of the present invention.

FIG. 3 is a flowchart for explaining developing device adjustment control performed by the laser beam printer according to the first embodiment. A program for executing the control process shown in this flow chart is stored in the program memory 111, and executed under the control of the CPU 110. Also, this control explained below is performed for each of the developing devices 14 (14Y to 14K) of different colors.

In step S1, this laser beam printer is in a printing standby state. In step S2, the laser beam printer receives printing data from the host computer 100 and is instructed to start printing, thereby starting a printing operation. The flow then advances to step S3 to start calculating a print quantity k (used amount information of the developing device) and toner consumption amount t [mg] to be described later.

The methods of calculating the print quantity K (the used amount information of the developing device) and toner consumption amount t [mg] in step S3 will be explained below.

In the printer of this embodiment, the print quantity is defined as the number of A4-size printed sheets. That is, when an image of A4 size (210 mm×297 mm=62,370 $mm^2$) or smaller is formed on the transfer belt 80 as an intermediate transfer member, 1 is counted up; when an image larger than A4 size and equal to or smaller than A3 size (420 mm×297 mm=124,740 $mm^2$) is formed, 2 is counted up. However, when images are printed on the two sides of the same sheet, 2 is counted up if images of A4 size or smaller are formed, and 4 is counted up if images larger than A4 size and equal to or smaller than A3 size are formed. The CPU 110 of the printer controller 101 determines this image size to be printed, in accordance with a sheet size to be used in printing, and stores the image size in "print quantity" of the RAM 112.

Also, in the printer according to this embodiment, the toner consumption amount t [mg] is defined as a toner consumption amount per sheet (i.e., one sheet when an image of A4 size or smaller is formed, and two sheets when an image larger than A4 size and equal to or smaller than A3 size is formed). When the laser exposing device 13 executes exposure corresponding to an image signal during printing, the printer controller 101 calculates the total number of pixels turned on by the laser as a pixel count value p, on the basis of an image signal for forming an electrostatic latent image on the photosensitive drum 70, and stores this value in "pixel counter" of the RAM 112.

The printer according to this embodiment has a resolution of 600 [dots/inch]×600 [dots/inch], so the area of one pixel as a minimum printing area is $(25.4\ [mm]/600)^2=1.79\times10^{-3}$ [$mm^2$]. On the other hand, in the printer according to this embodiment, the toner deposition amount per unit area is 0.0065 [$mg/m^2$]. Accordingly, the toner consumption amount t [mg] per sheet is calculated by $$t[mg]=p\times1.79\times10^{-3}\times0.0065[mg] \quad (1)$$

by using the pixel count value p per sheet.

The thus calculated toner consumption amount is stored in "toner consumption amount" of the RAM 112.

The flow then advances to step S4, and the print quantity k and toner consumption amount t [mg] calculated in step S3 are added to accumulated values ("accumulated print quantity" and "accumulated toner consumption amount" of the RAM 112) up to the last printing. "Accumulated print quantity" is represented by K, and "accumulated toner consumption amount" from the first to Kth sheets is represented by T [mg].

In step S5, it is determined whether the accumulated print quantity K calculated in step S4 is 100 or more. If YES in step S5, the flow advances to step S6. If NO in step S5, the flow returns to the printing standby state in step S1 to continue the calculation and updating of the accumulated print quantity K and accumulated toner consumption amount T on and after the next printing.

If 100 or more sheets are printed and the flow advances to step S6, it is determined whether the condition indicated by $$T[\text{mg}]<405[\text{mg}] \tag{2}$$

is met. If YES in step S6, the flow advances to step S7 to perform developing device adjustment control.

If the condition of equation (2) is not met in step S6, the flow advances to step S8 to reset K=0 and T=0 without performing any developing device adjustment control. After that, the flow returns to step S1 to continue the calculation and updating of the accumulated print quantity K and accumulated toner consumption amount T on and after the next printing.

The reason why the condition of equation (2) is determined will be explained below.

The present inventors made extensive studies and have found that in the laser beam printer according to the first embodiment, if 100 or more sheets are continuously printed while the average toner consumption amount per sheet is smaller than a toner consumption amount threshold value r [mg] (=4.05 [mg]), the probability of a decrease in density of solid images and the like and deterioration of the image quality of line images and characters increases. In the first embodiment, therefore, developing device adjustment control is executed when the toner consumption amount per 100 sheets is smaller than 405 [mg] (=r [mg]×100).

Note that even if the toner consumption amount per sheet is smaller than toner consumption amount threshold value r [mg]=4.05 [mg], in practice the number of printed sheets before the probability of the decrease in density of solid images and the like or the deterioration of the image quality of lines images or characters increases changes in accordance with the toner consumption amount. That is, when the average toner consumption amount per sheet is close to 0.00 [mg] (e.g., 0.01 [mg]), the number of printed sheets before the probability of the image quality deterioration increases is about 100. In contrast, when the average toner consumption amount per sheet is 4.00 [mg], the number of printed sheets before the probability of the image quality deterioration increases is about 1,000. Therefore, the print quantity for determining whether to perform developing device adjustment control may also be changed in accordance with the toner consumption amount.

In the first embodiment, however, the control is simplified by fixing the number of printed sheets before the rise of the probability of the image quality deterioration to 100 regardless of the toner consumption amount. The number of printed sheets is fixed to 100 because it is essential to perform developing device adjustment control for every about 100 sheets under the worst conditions in which the average toner consumption amount per sheet is close to 0.00 [mg].

The above studies were made in a 23° C.-60% RH environment by using the developing devices 14 whose conditions were close to those of brand-new products.

A method of changing the performance specifications of developing device adjustment control in accordance with the use environment or the use condition of the developing device 14 will be described later in the second embodiment.

Processing performed when developing device adjustment control is started in step S7 will be explained below.

First, in the image forming station 10Y, a yellow solid image having a width (in the first embodiment, 297 mm which is equal to the maximum sheet width) covering the entire region in the main scan direction is developed as a developing device adjusting toner image on the photosensitive drum 70Y. This developing device adjusting toner image is transferred onto the intermediate transfer belt 80 in the primary transfer portion of the image forming station 10Y. The yellow solid image thus transferred onto the intermediate transfer belt 80 is passed through the primary transfer portions of the image forming stations 10M, 10C, and 10K, conveyed to the belt cleaner 33, and collected.

In the image forming station 10M, a magenta solid image is formed on the photosensitive drum 70M so as to reach the primary transfer portion in synchronism with the timing at which the passage of the yellow solid image is complete. This magenta solid image is transferred onto the intermediate transfer belt 80 subsequently to the yellow solid image. After that, developing device adjusting toner images are similarly formed in the image forming stations 10C and 10K. While this developing device adjustment control is being executed, the secondary transfer roller 55 is separated from the intermediate transfer belt 80 in order to avoid contamination by the developing device adjusting toner images on the intermediate transfer belt 80.

When the developing device adjusting toner images are formed as described above, a toner consumption amount S in each color developing device 14 during this developing device adjustment control is determined by $$S[\text{mg}]=405[\text{mg}]-T[\text{mg}] \tag{3}$$

Accordingly, a length d [mm] in the sub scan direction of the solid image formed in each image forming station is determined by $$d[\text{mm}]=S[\text{mg}]/0.0065[\text{mg/mm}^2]/297[\text{mm}] \tag{4}$$

By first calculating the amount of toner consumed when adjustment of the developing device 14 is controlled by using equation (4) above and then performing the control, the average developer consumption amount per sheet when the number of printed sheets is 100 can be maintained at 4.05. [mg]. This makes it possible to prevent the decrease in density of solid images and the like and the deterioration of the image quality of line images and characters.

In addition, since toner is not excessively consumed when the developing device adjustment control is performed, it is also possible to suppress an increase in running cost when the user uses this laser beam printer.

After the adjustment of the developing devices 14 is thus controlled, the flow advances to step S8 to reset K=0 and T=0, and returns to step S1 again to continue the calculation and updating of the accumulated print quantity K and accumulated toner consumption amount T on and after the next printing.

In the first embodiment as explained above, when each developing device 14 is to discharge an adjusting toner image during adjustment control of the developing device 14, control is so performed that the toner consumption amount S [mg], accumulated toner consumption amount T [mg], accumulated print quantity K, and toner consumption amount threshold value r [mg] during the adjustment control of the developing device 14 have the relationship indicated by $$S[\text{mg}]=r[\text{mg}]\times K-T[\text{mg}] \quad (5)$$

Accordingly, even when the user keeps printing images whose printing ratio (pixel ratio indicating the existence of pixels per page) is low over a long time, it is possible to properly maintain the toner amount discharged during adjustment control of each developing device 14, and effectively prevent the decrease in density of solid images and the like and the deterioration of the image quality of solid lines and characters. It is also possible to restrain the increase in running cost when the user uses the printer.

Note that the toner consumption amount S [mg] during adjustment control of each developing device 14 need not always be determined as in the first embodiment. That is, the toner consumption amount S [mg] can also be determined by some other method which refers to the accumulated toner consumption amount T [mg] and accumulated print quantity K by taking account of the characteristics of developing devices in each individual printer.

For example, the toner consumption amount S [mg] during adjustment control of each developing device 14 may also be calculated on the basis of an equation different from equation (5) by using the accumulated toner consumption amount T [mg] and accumulated print quantity K.

Alternatively, the toner consumption amount S [mg] during developing device adjustment control can be determined by using a table by which the toner consumption amount S is uniquely determined on the basis of the accumulated toner consumption amount T [mg] and accumulated print quantity K.

[Second Embodiment]

The second embodiment of the present invention will be described below. In the second embodiment, control is performed in accordance with the use condition of a printer so that a developing device 14 discharges toner in an amount necessary and enough to prevent defective images caused by the developing device 14. The apparatus configuration and the like according to the second embodiment are similar to the first embodiment described above, so an explanation thereof will be omitted.

In the developing device adjustment control described in the first embodiment, the amount of each color toner discharged from the developing device 14 is determined by equation (5) by using the toner consumption amount threshold value r [mg]. However, the value of r [mg] can be increased or decreased where necessary in accordance with, e.g., the environment or the total print quantity of the developing device 14. That is, control can be performed in accordance with the use condition of the printer so that the developing device 14 discharges toner in an amount necessary and enough to prevent defective images caused by the developing device 14.

In developing device adjustment control according to the second embodiment, the toner consumption amount threshold value r [mg] is determined for each of developing devices 14 of different colors on the basis of environment information acquired by a built-in environment sensor of the printer, or used information of the developing device 14 of the printer.

FIG. 4 depicts a view showing an example of a table, according to the second embodiment of the present invention, which is used to change the toner consumption amount threshold value r [mg] in accordance with the environment (the temperature and humidity), or the use condition (0%: initial state to 100%: after a total of 20,000 sheets are printed by the same counting method as in step S3 of the developing device adjustment control explained in the first embodiment) of the developing device 14.

Referring to FIG. 4, the higher the temperature and humidity of the environment or the farther the use condition of the developing device 14 from the initial condition, the smaller the value of the toner consumption amount threshold value r [mg]. That is, in a high-temperature, high-humidity environment in which the average triboelectrification of toner of the developing device 14 easily lowers, or in the developing device 14 whose use condition is far from the initial condition, the amount of strongly charged toner hardly increases even if a user keeps printing images having a low printing ratio over a long time. Therefore, even when adjustment control of the developing device 14 is performed using a small toner consumption amount threshold value r [mg], it is possible to effectively prevent a decrease in density of solid images and the like and deterioration of the image quality of line images and characters.

As described above, the table shown in FIG. 4 is formed by predicting, in accordance with the environment or the use condition of the developing device 14, the minimum toner consumption amount threshold value r [mg] necessary to effectively prevent the decrease in density of solid images and the like and the deterioration of the image quality of solid images and characters.

In the second embodiment as described above, in adjustment control of each developing device 14, the toner consumption amount threshold value r [mg] is changed in accordance with the environment or the total print quantity of the developing device 14. Therefore, it is possible to discharge toner in a proper amount to prevent defective printed images caused by the developing device 14 in accordance with the use condition of the printer, and effectively prevent the decrease in density of solid images and the like and the deterioration of the image quality of line images and characters. Furthermore, it is also possible to suppress an increase in running cost when the user uses the printer.

Note that a toner consumption amount S [mg] during adjustment control of each developing device 14 need not always be determined by the method of the second embodiment. That is, the toner consumption amount S [mg] can also be determined by some other method by referring to an accumulated toner consumption amount T [mg], an accumulated print quantity K, the environment, or the total print quantity of the developing device 14.

If the characteristic change of each developing device 14 largely depends on the environment or on the total print quantity of the developing device 14, rather than the accumulated toner consumption amount T [mg] or accumulated print quantity K, the toner consumption amount S [mg] during adjustment control of the developing device 14 can also be determined by referring to only the environment or the total print quantity of the developing device 14 in order to simplify the control.

[Third Embodiment]

The third embodiment of the present invention will be described below. In the third embodiment, control is performed in accordance with the characteristics of developing devices of different colors so that each developing device 14 discharges toner in an amount necessary and enough to prevent defective images caused by the developing device 14. The apparatus configuration and the like according to the third embodiment are similar to the first embodiment described above, so an explanation thereof will be omitted.

In the developing device adjustment control described in the first embodiment, the amount of each color toner discharged from the developing device 14 is determined by equation (5) by using the toner consumption amount threshold value r [mg]. However, different values can be set as the threshold value r [mg] for developing devices 14Y to 14K of different colors. That is, control can be performed in accordance with the characteristics of the developing devices 14 of different colors so that each developing device 14 discharges toner in an amount necessary and enough to prevent defective images caused by the developing device 14.

In developing device adjustment control according to the third embodiment, the toner consumption amount threshold value r [mg] is designated for each of the developing devices 14Y to 14K.

FIG. 5 depicts a view showing an example of a table for setting the toner consumption amount threshold value r [mg] in accordance with each of the developing devices 14Y to 14K. The data of this table is obtained in a 23° C.-60% RH environment when the use condition is 0%.

Referring to FIG. 5, a toner consumption amount threshold value r [mg] smaller than that of the C developing device 14C and M developing device 14M is set for the K developing device 14K, and a toner consumption amount threshold value r [mg] larger than that of the C developing device 14C and M developing device 14M is set for the Y developing device 14Y. In the K developing device 14K using low-resistance toner, the amount of strongly charged toner hardly increases even if a user keeps printing images having a low printing ratio over a long time. Therefore, even when adjustment control of the developing device 14 is performed using a small toner consumption amount threshold value r [mg], it is possible to effectively prevent a decrease in density of solid images and the like and deterioration of the image quality of line images and characters.

By contrast, the amount of strongly charged toner readily increases in the Y developing device 14Y using high-resistance toner. So, the above phenomena cannot be effectively prevented unless adjustment control of the developing device 14 is performed using a large toner consumption amount threshold value r [mg].

As described above, the table shown in FIG. 5 is formed by predicting, in accordance with the characteristics of toner of each color developing device 14, the minimum toner consumption amount threshold value r [mg] necessary to effectively prevent the decrease in density of solid images and the like and the deterioration of the image quality of solid images and characters.

In the third embodiment as described above, in adjustment control of the developing devices 14, different toner consumption amount threshold values r [mg] are set for the developing devices 14Y to 14K of different colors. Therefore, in accordance with the characteristics of toner of each color developing device 14, it is possible to discharge toner in a proper amount to prevent defective images caused by the developing device 14, and effectively prevent the decrease in density of solid images and the like and the deterioration of the image quality of line images and characters. Furthermore, it is also possible to suppress an increase in running cost when the user uses the printer.

[Fourth Embodiment]

The fourth embodiment of the present invention will be described below. In the fourth embodiment, adjustment control by which developing devices 14 are idled will be described below. The apparatus configuration and the like according to the fourth embodiment are similar to the first embodiment described above, so an explanation thereof will be omitted.

Methods of detecting the number of printed sheets and the toner consumption amount during image formation and developing device adjustment control based on these pieces of information as the characteristic features of a printer according to the fourth embodiment will be described below. Note that operations such as detection, calculations, printing, and determination in the control according to the fourth embodiment are executed by a CPU 110 of a printer controller 101.

Figure 6:
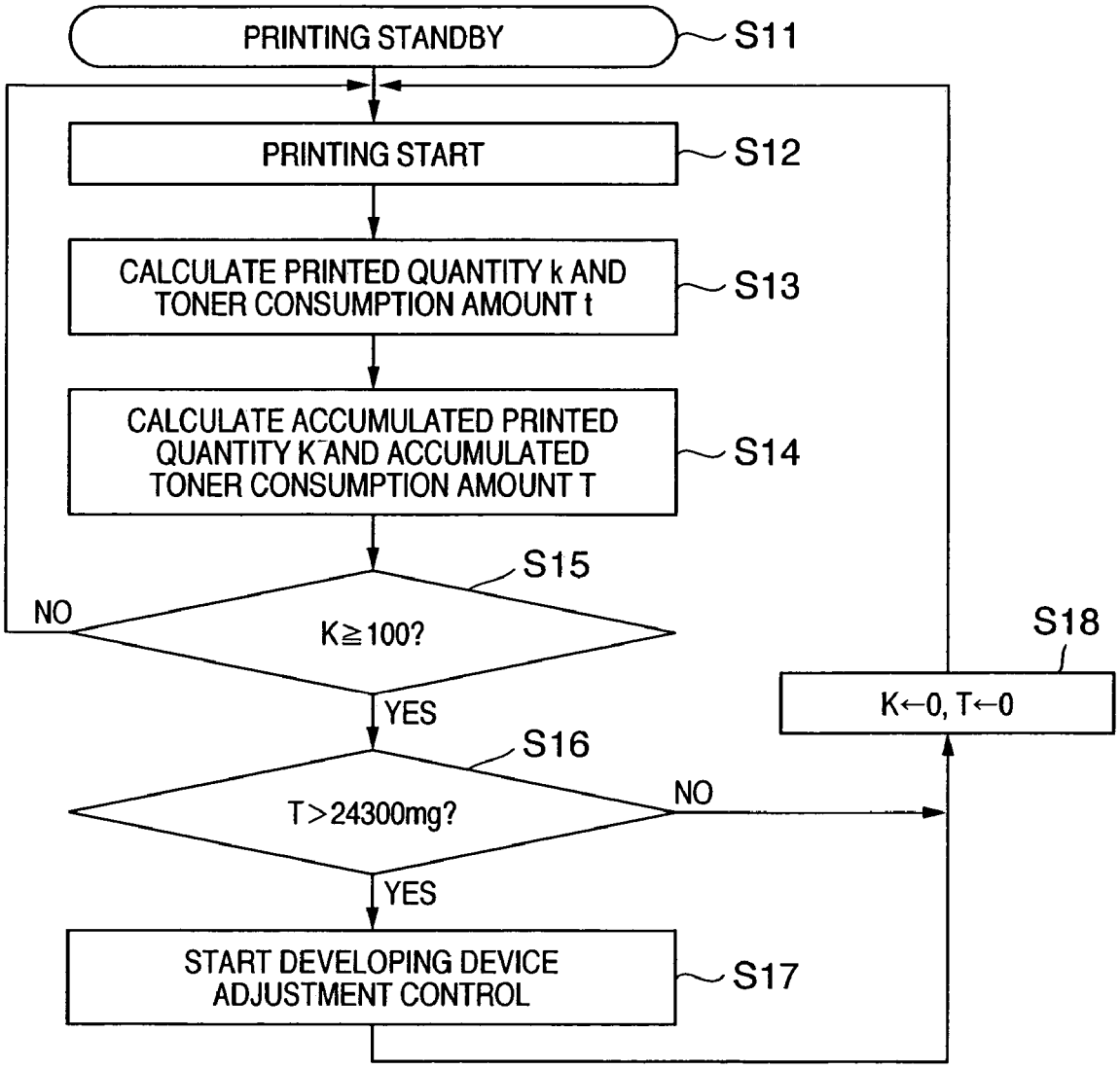
FIG. 6 is a flowchart for explaining a developing device adjustment control process in a laser beam printer according to the fourth embodiment of the present invention.

FIG. 6 is a flowchart for explaining developing device adjustment control performed by the laser beam printer according to the fourth embodiment of the present invention. This control explained below is performed for each of developing devices 14 (14Y to 14K) of different colors.

Steps S11 to S14 are the same as steps S1 to S4 explained in the first embodiment with reference to FIG. 3, so a detailed description thereof will be omitted.

If in step S15 an accumulated print quantity K calculated in step S14 is 100 or more, the flow advances to step S16. If NO in step S15, the flow returns to a printing standby state in step S11 to calculate and update the accumulated print quantity K and an accumulated toner consumption amount T on and after the next printing.

If in step S16 the condition indicated by $$T[\text{mg}]<24300[\text{mg}] \tag{6}$$

is met, the flow advances to step S17 to perform adjustment control of the developing device 14.

If the condition of equation (6) is not met in step S16, the flow advances to step S18 to reset K=0 and T=0 without performing any adjustment control of the developing device 14. After that, the flow returns to step S11 to calculate and update the accumulated print quantity K and accumulated toner consumption amount T on and after the next printing.

The reason why the condition of equation (6) is determined will be explained below.

The present inventors made extensive studies and have found that in the printer according to the fourth embodiment, if 100 or more sheets are continuously printed while the average toner consumption amount per sheet is larger than toner consumption amount upper-limiting threshold value r' [mg]=243 [mg], the probability of an increase in density of solid images and the like or fogging increases.

In the printer according to the fourth embodiment, therefore, adjustment control of the developing device 14 is executed when the toner consumption amount per 100 sheets is larger than 24,300 [mg] (=r' [mg]×100).

Note that even if the toner consumption amount per sheet is larger than toner consumption amount upper-limiting threshold value r' [mg]=243 [mg], in practice the number of printed sheets before the probability of the increase in density of solid images and the like or fogging increases, changes in accordance with the toner consumption amount. That is, when the average toner consumption amount per sheet is, e.g., 405 [mg], the number of printed sheets before the probability of the increase in density of solid images and the like or fogging increases is about 100. In contrast, when the average toner consumption amount per sheet is 243 [mg], the number of printed sheets before the same phenomenon occurs is about 1,000. Therefore, the print quantity for determining whether to perform adjustment control of the developing device 14 may also be changed in accordance with the average toner consumption amount per sheet.

In the fourth embodiment, however, the control is simplified by fixing the number of printed sheets to 100 regardless of the toner consumption amount. The number of printed sheets is fixed to 100 because it is essential to perform adjustment control of the developing device 14 for every 100 sheets under the worst conditions in which the average toner consumption amount per sheet is 405 [mg] (assuming an entirely solid image).

The above studies were made in a 23° C.-60% RH environment by using the developing devices 14 whose conditions were close to those of brand-new products. A method of changing the specifications of adjustment control of the developing device 14 in accordance with the environment or the use condition of the developing device 14 will be described in the fifth embodiment to be described later.

When adjustment control of the developing device 14 is thus started in step S17, printing is interrupted, and idling of a developing sleeve of the developing device 14 is started in each of image forming stations 10Y to 10K. Although the developing sleeve in the developing device 14 rotates as during a printing operation is being performed, application of a developing voltage is stopped.

An idling time U of the developing sleeve in the developing device 14 is determined by $$U[s]=ua[s]+ub[s/\mathrm{mg}]\times(T[\mathrm{mg}]-24300[\mathrm{mg}]) \quad (7)$$

where ua and ub are coefficients for calculating the idling time. In the printer according to the fourth embodiment, these coefficients are so optimized that ua [s]=20 [s] and ub [s/mg]=0.0025 [s/mg].

By first calculating the idling time of the developing sleeve when adjustment of the developing device 14 is controlled by using equation (7) above and then performing the control, toner in the developing device 14 can be kept well agitated when the number of printed sheets is 100. This makes it possible to prevent the increase in density of solid images and the like and fogging.

In addition, since no idling is excessively performed when the adjustment control of the developing device 14 is performed, it is also possible to suppress a decrease in throughput of the printer.

After the adjustment control of the developing devices 14 according to the fourth embodiment is thus performed, the flow advances to step S18 to reset K=0 and T=0, and returns to step S11 to continue the calculation and updating of the accumulated print quantity K and accumulated toner consumption amount T on and after the next printing.

In the fourth embodiment as explained above, when the developing sleeve is to be idled during adjustment control of the developing device 14, control is so performed that the developing sleeve idling time U [s], accumulated toner consumption amount T [mg], accumulated print quantity K, toner consumption amount upper-limiting threshold value r' [mg], and idling time calculation coefficients ua [s] and ub [s/mg] have the relationship indicated by $$U[s]=ua[s]+ub[s/\mathrm{mg}]\times(T[\mathrm{mg}]-r'[\mathrm{mg}]\times K) \quad (8)$$

Accordingly, even when the user keeps printing images having a high printing ratio over a long time, it is possible to properly maintain the developing sleeve idling time during adjustment control of each developing device 14, and effectively prevent, the increase in density of solid images and the like and fogging. It is also possible to restrain the decrease in throughput of the printer.

Note that the developing sleeve idling time U [s] need not always be determined by the method of the fourth embodiment. That is, the developing sleeve idling time U [s] can also be determined by some other method which refers to the accumulated toner consumption amount T [mg] and accumulated print quantity K by taking account of the characteristics of the developing devices 14 in each individual printer. For example, the developing sleeve idling time U [s] may also be calculated on the basis of an equation different from equation (8) by using the accumulated toner consumption amount T [mg] and accumulated print quantity K. Alternatively, the developing sleeve idling time U [s] can be determined by using a table by which the developing sleeve idling time U [s] is uniquely determined on the basis of the accumulated toner consumption amount T [mg] and accumulated print quantity K.

[Fifth Embodiment]

The fifth embodiment of the present invention will be described below. In the fifth embodiment, control is performed in accordance with the use condition of a printer so that a developing sleeve is idled for a time necessary and enough to prevent defective images caused by the developing device 14. The apparatus configuration and the like according to the fifth embodiment are similar to the fourth embodiment described above, so an explanation thereof will be omitted.

In the developing device adjustment control described in the fourth embodiment, the idling time of the developing sleeve in each color developing device 14 is determined by equation (8) by using the toner consumption amount upper-limiting threshold value r' [mg]. However, as in the second embodiment, the value of r' [mg] can be increased or decreased where necessary in accordance with, e.g., the environment or the total print quantity of the developing device 14. That is, control can be performed in accordance with the use condition of the printer so that the developing sleeve is idled for a time necessary and enough to prevent defective images caused by the developing device 14.

In the adjustment control of the developing device 14 according to the fifth embodiment, the toner consumption amount upper-limiting threshold value r' [mg] is determined for each color developing device 14 on the basis of environment information acquired by a built-in environment sensor of the printer, or use information of the developing device 14 of the printer.

FIG. 7 depicts a view showing an example of a table, according to the fifth embodiment of the present invention, which is used to change the toner consumption amount upper-limiting threshold value r' [mg] in accordance with the environment (the temperature and humidity), or the use condition (0%: initial state to 100%: after a total of 20,000 sheets are printed by the same counting method as in step S3 of the developing device adjustment control explained in the first embodiment) of the developing device 14.

Referring to FIG. 7, the lower the temperature and humidity of the environment or the closer the use condition of the developing device 14 to the initial condition, the larger the value of the toner consumption amount upper-limiting threshold value r' [mg]. That is, in a low-temperature, low-humidity environment in which the average triboelectrification of toner in the developing device 14 easily rises, or in the developing device 14 whose use condition is close to the initial condition, the amount of weakly charged toner or reverse-polarity toner hardly increases even if a user keeps printing images having a high printing ratio over a long time. Therefore, even when developing device adjustment control is performed using a large toner consumption amount upper-limiting threshold value r' [mg], it is possible to effectively prevent an increase in density of solid images and the like and fogging.

As described above, the table shown in FIG. 7 is formed by predicting, in accordance with the environment or the use condition of the developing device 14, the toner consumption amount upper-limiting threshold value r' [mg] necessary to effectively prevent the increase in density of solid images and the like and fogging.

In the fifth embodiment as described above, in adjustment control of each developing device 14, the toner consumption amount upper-limiting threshold value r' [mg] is changed in accordance with the environment or the total print quantity of the developing device 14. Therefore, it is possible to idle the developing sleeve for a proper time to prevent defective images caused by the developing device 14 in accordance with the use condition of the printer, and effectively prevent the increase in density of solid images and the like and fogging. Furthermore, it is also possible to suppress a decrease in throughput of the printer.

Note that an idling time U [s] of the developing sleeve need not always be determined by the method of the fifth embodiment. That is, the idling time U [s] of the developing sleeve can also be determined by some other method by referring to an accumulated toner consumption amount T [mg], an accumulated print quantity K, the environment, or the total print quantity of the developing device 14.

If the characteristic change of each developing device 14 largely depends on the environment or on the total print quantity of the developing device 14, rather than the accumulated toner consumption amount T [mg] or accumulated print quantity K, the idling time U [s] of the developing sleeve of the developing device can also be determined by referring to only the environment or the total print quantity of the developing device 14 in order to simplify the control.

[Sixth Embodiment]

The sixth embodiment of the present invention will be described below. In the sixth embodiment, as in the third embodiment, control is so performed as to set different r' [mg] values for developing devices 14Y to 14K of different colors. The apparatus configuration and the like according to the sixth embodiment are similar to the fourth embodiment described above, so an explanation thereof will be omitted.

In the adjustment control of the developing devices 14 described in the fourth embodiment, the idling time of a developing sleeve of each color developing device 14 is determined by equation (8) by using the toner consumption amount upper-limiting threshold value r' [mg]. As in the third embodiment, different values of r' [mg] can be set for the developing devices 14Y to 14K of different colors. That is, control can be performed in accordance with the characteristics of each color developing device 14 so that the developing device 14 is idled for a time necessary and enough to prevent defective images caused by the developing device 14.

In developing device adjustment control according to the sixth embodiment, the toner consumption amount upper-limiting threshold value r' [mg] is designated for each of the developing devices 14Y to 14K.

FIG. 8 depicts a view showing an example of a table for changing the toner consumption amount upper-limiting threshold value r' [mg] in accordance with each of the developing devices 14Y to 14K. The data of this table is obtained in a 23° C.-60% RH environment when the use condition is 0%.

Referring to FIG. 8, a toner consumption amount upper-limiting threshold value r' [mg] larger than that of the C developing device 14C and M developing device 14M is set for the Y developing device 14Y, and a toner consumption amount upper-limiting threshold value r' [mg] smaller than that of the C developing device 14C and M developing device 14M is set for the K developing device 14K.

That is, in the Y developing device 14Y using high-resistance toner, the amount of weakly charged toner or reverse-polarity toner hardly increases even if a user keeps printing images having a high printing ratio over a long time. Therefore, even when adjustment control of the developing device 14 is performed using a large toner consumption amount threshold value r [mg], it is possible to effectively prevent an increase in density of solid images and the like and fogging. In contrast, the amount of weakly charged toner readily increases in the K developing device 14K using low-resistance toner. So, the above phenomena cannot be effectively prevented unless adjustment control of the developing device 14 is performed using a small toner consumption amount threshold value r [mg].

As described above, the table shown in FIG. 8 is formed by predicting, in accordance with the characteristics of toner of each color developing device 14, the toner consumption amount upper-limiting threshold value r' [mg] necessary to effectively prevent the increase in density of solid images and the like and fogging.

In the sixth embodiment as described above, in adjustment control of the developing devices 14, different toner consumption amount upper-limiting threshold values r' [mg] are set for the developing devices 14Y to 14K of different colors. Therefore, in accordance with the characteristics of toner of each color developing device 14, it is possible to idle the developing sleeve for a proper time to prevent defective images caused by the developing device 14, and effectively prevent the increase in density of solid images and the like and fogging. It is also possible to suppress a decrease in throughput of the printer.

[Seventh Embodiment]

The seventh embodiment of the present invention will be described below. This embodiment is wherein information concerning the toner consumption amount threshold value in the third and sixth embodiments described above is stored in a memory of a developing device 14 detachably installed in an image forming apparatus. On the basis of this information stored in the memory and concerning the toner consumption amount threshold value corresponding to the characteristics of toner of each color developing device, it is possible to control the adjustment of the developing device 14 and control the idling time of a developing sleeve of the developing device 14.

As already explained in the third and sixth embodiments, a pigment included in toner changes in accordance with the color of toner, so the characteristics also differ from one toner to another. Therefore, even when key parts used in development are identical, the degree of deterioration and the degree of charging of toner of one color are different from those of toner of another color. These differences have an influence on the image quality.

For example, in a K developing device 14K using low-resistance toner, the amount of strongly charged toner hardly increases even if a user keeps printing images having a low printing ratio over a long time. Therefore, even when developing device adjustment control is performed using a small toner consumption amount threshold value r [mg], it is possible to effectively prevent a decrease in density of solid images and the like and deterioration of the image quality of line images and characters. In contrast, the amount of strongly charged toner readily increases in a Y developing device 14Y using high-resistance toner. So, these phenomena cannot be effectively prevented unless developing device adjustment control is performed using a large toner consumption amount threshold value r [mg].

Likewise, in the Y developing device 14Y using high-resistance toner, the amount of weakly charged toner or reverse-polarity toner hardly increases even if a user keeps printing images having a high printing ratio (large toner consumption amount of images) over a long time. Therefore, even when adjustment control of the developing device 14 is performed using a large toner consumption amount threshold value r [mg], it is possible to effectively prevent an increase in density of solid images and the like and fogging. By contrast, the amount of weakly charged toner readily increases in the K developing device 14K using low-resistance toner. So, the above phenomena cannot be effectively prevented unless adjustment control of the developing device 14 is performed using a small toner consumption amount threshold value r [mg].

Figure 10:
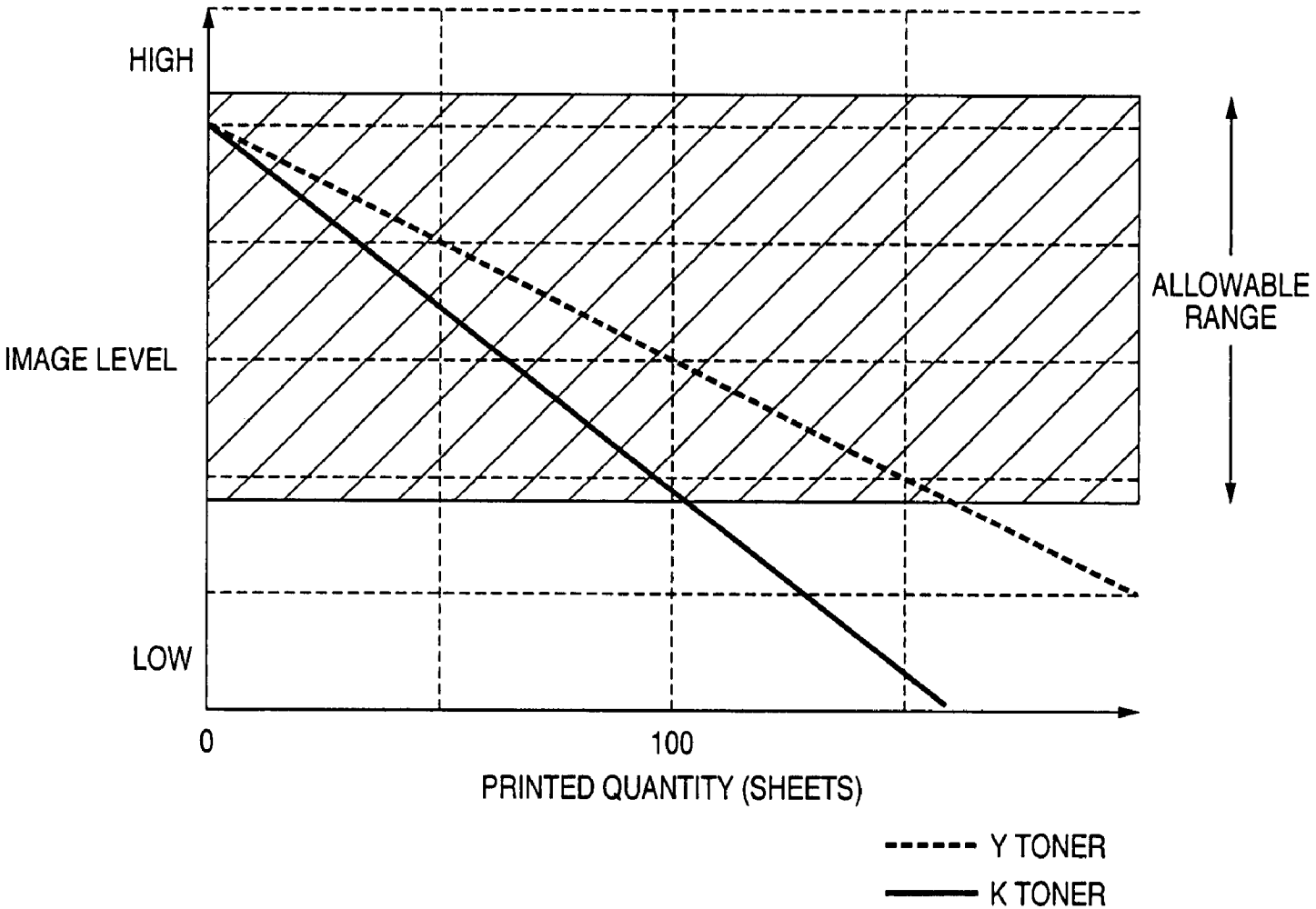
FIG. 10 depicts a graph showing changes in Y- and K-toner image levels when images having a low printing ratio continue.

FIG. 10 depicts a graph showing changes in Y- and K-toner image levels when images having a low printing ratio continue. As described above, the high-resistance Y toner is influenced more strongly than the low-resistance K toner for the same number of sheets of 100. That is, if the same toner consumption amount threshold value is used for different toner components, these toner components are wasted. More specifically, if the toner consumption amount threshold value is set in accordance with the Y toner, the K toner is wasted. C toner and M toner also have characteristics different from the Y tone and K toner, and change their image levels in different ways accordingly.

Note that even when images having a high printing ratio continue, toner components of different colors change their image levels in different ways.

To control these differences between the characteristics of toner components of different colors, the information pertaining to the toner consumption amount threshold value corresponding to the characteristics of each color toner is stored in the memory of the developing device 14. This makes it possible to control the adjustment of each color developing device 14 in accordance with its characteristics, and control the idling of the developing sleeve of the developing device 14.

The configuration of the memory of the developing device 14 will be described with reference to FIG. 9. Note that the control of the formation of a toner image for adjusting the developing device 14 and the control of the idling of the developing sleeve of the developing device 14 are already explained in the first to sixth embodiments, so a detailed explanation thereof will be omitted.

Figure 9:
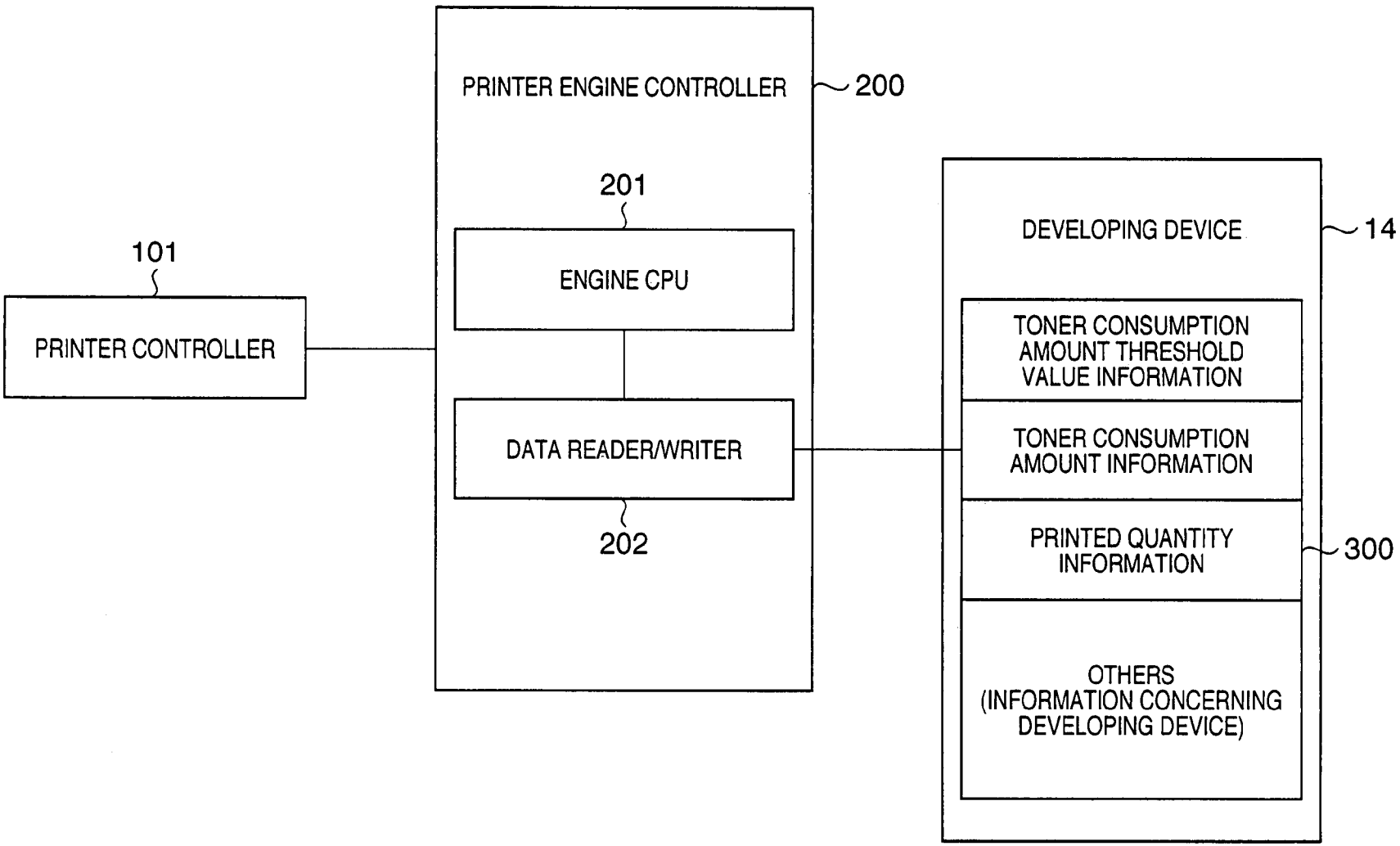
FIG. 9 depicts a view for explaining the configuration of a memory of a developing device in the seventh embodiment of the present invention.

FIG. 9 depicts a view showing the connections between a printer controller 101, a printer engine controller 200 of a printer engine, and a memory 300 as a storage medium (storage unit) of the developing device 14. The memory 300 of the developing device 14 and the printer engine controller 200 are connected by bringing a contact (not shown) of the memory and a contact (not shown) of the printer main body into contact with each other. Data communication (read/write) is performed by a data reader/writer 202 of the printer engine controller 200.

In this embodiment, after the developing device 14 is attached to the printer main body and the memory 300 is connected to the printer main body, the information concerning the toner consumption amount threshold value is read out from the memory 300, and the data is transmitted to an engine CPU 201. The engine CPU 201 transfers the received data to the printer controller 101. As described in the first embodiment, the printer controller 101 performs processing for controlling the adjustment of the developing device 14, or for controlling the idling time of the developing sleeve of the developing device 14. Note that the adjustment control of the developing device 14 or the control of the idling time of the developing sleeve of the developing device 14 may also be performed by the engine controller 200, rather than the printer controller 101.

The memory 300 has an area for storing the information concerning the toner consumption amount threshold value, and also has an area for storing print quantity information, toner consumption amount information, and others (information pertaining to the developing device).

The developing device 14 has at least a vessel for containing a developer, and the developing sleeve (roller) for supplying the developer to a photosensitive drum.

In this embodiment as described above, each color developing device 14 has the memory 300, and the toner consumption amount threshold value corresponding to the characteristics (toner characteristics) of the developing device 14 is stored in the memory 300. By controlling the adjustment of each developing device 14 in accordance with the characteristics of the developing device 14, it is possible to effectively prevent a decrease in density of solid images and the like and deterioration of the image quality of line images and characters. It is also possible to suppress an increase in running cost when the user uses the printer.

Also, a toner consumption amount threshold value corresponding to the characteristics (toner characteristics) of each color developing device 14 is stored in the memory 300, and the idling time of the developing sleeve of the developing device 14 is controlled on the basis of this value. This makes it possible to effectively prevent an increase in density of solid images and the like and fogging, and suppress a decrease in throughput of the printer.

The first to seventh embodiments are described above.

The present invention is not limited to the arrangements of the printers and developing devices described in the first to seventh embodiments described above, but can be applied to, e.g., a contact development system, non-contact jumping development system, monocomponent development system, two-component development system, magnetic development system, and nonmagnetic development system in various forms of printers. That is, the present invention is applicable to all forms of developing devices.

Also, the environment information in each of the second and fifth embodiments is acquired by the built-in environment sensor of the printer. However, this environment information may also be acquired by another means. For example, if the electrical resistance of any of, e.g., the intermediate transfer belt 80, primary transfer rollers 54 (54Y to 54K), and secondary transfer roller 55 has environment dependence, the environment information can be acquired by detecting this electrical resistance.

The use information of each the developing devices 14 (14Y to 14K) may also be stored in an internal driver of a personal computer for operating the printer, instead of the built-in memory of the developing device 14 of the printer.

In the control method of each of the fourth to the sixth embodiments, the timing of adjustment control of the developing device 14 is fixed (e.g., every 100 sheets), and the idling time of the developing sleeve of the developing device is determined by referring to, for example, the accumulated toner consumption amount, the accumulated print quantity, the environment, and the total print quantity of the developing device. However, it is also possible to use a control method by which the idling time of the developing sleeve is fixed (e.g., to 20 [s]), and the timing of adjustment control of the developing device 14 is determined by referring to, e.g., the accumulated toner consumption amount, the accumulated print quantity, the environment, and the total print quantity of the developing device. By this control method, when adjustment control of the developing device 14 is performed once, the idling time of the developing sleeve can be restricted to a short time period. When a user is to obtain a printing output, therefore, the waiting time by the adjustment control of the developing device 14 can be reduced to such an extent that the user does not feel uncomfortable.

In each of the first to seventh embodiments described above, whether to consume toner or rotate the developing roller is determined by comparing the accumulated toner consumption amount with the toner consumption amount threshold value r' for every predetermined number of sheets (100). However, it is of course also possible to calculate a toner consumption amount per sheet and compare this value with the toner consumption amount threshold value r.

Also, in each of the first to seventh embodiments described above, the developing device adjusting operation is executed at a timing except for a normal printing operation of forming an image on a printing sheet. For example, this adjusting operation is executed during an initialization sequence (preparation) before the printing operation is started, or during post-processing (e.g., during the period of a post-rotation process such as a charge removing sequence of removing the electric charge on the drum) after the printing operation is complete. If a plurality of printing jobs are continuously performed, the adjusting operation is executed by setting a predetermined period between these print jobs.

[Other Embodiments]

As described earlier, the objects of the present invention can also be achieved by providing a storage medium storing the program code of software for implementing the functions of the above embodiments to a system or apparatus, and reading out and executing the program code stored in the storage medium by a computer (or a CPU or MPU) of the system or apparatus. In this case, the program code itself read out from the storage medium implements the functions of the above embodiments, and the storage medium storing this program code constitutes the invention. As this storage medium for supplying the program code, it is possible to use, e.g., a floppy (registered trademark) disk, hard disk, optical disk, magnetooptical disk, CD-ROM, CD-R, magnetic tape, nonvolatile memory card, and ROM.

In addition, besides the functions of the above embodiments are implemented by executing the readout program code by the computer, the present invention includes a case where an OS (Operating System) or the like running on the computer performs part or the whole of actual processing in accordance with designations by the program code and thereby implements the functions of the embodiments.

Furthermore, the present invention also includes a case where the program code read out from the storage medium is written in a memory of a function expansion board inserted into the computer or of a function expansion unit connected to the computer, and, in accordance with designations by the program code, a CPU or the like of the function expansion board or function expansion unit performs part or the whole of actual processing and thereby implements the functions of the above embodiments.

As described above, the embodiments of the present invention are wherein when a developing device is to discharge a developing device adjusting toner image during developing device adjustment control, control is so performed that the toner consumption amount S [mg], accumulated toner consumption amount T [mg], accumulated print quantity K, and toner consumption amount threshold value r [mg] during the developing device adjustment control have the relationship indicated by S [mg]=r [mg]×K−T [mg].

Accordingly, even when a user keeps printing images having a low printing ratio, it is possible to properly maintain the toner amount discharged during the developing device adjustment control, and effectively prevent the decrease in density of solid images and the like and the deterioration of the image quality of solid lines and characters.

It is also possible to suppress the increase in running cost when the user uses the printer.

Also, when the developing sleeve is to be idled during developing device adjustment control, the control is so performed that the developing sleeve idling time U [s], accumulated toner consumption amount T [mg], accumulated print quantity K, toner consumption amount upper-limiting threshold value r' [mg], and idling time calculation coefficients ua [s] and ub [s/mg] have the relationship indicated by U [s]=ua [s]+ub [s/mg]×(T [mg]−r' [mg]×K).

Accordingly, even when a user keeps printing images having a high printing ratio over a long time, it is possible to properly maintain the developing sleeve idling time during the developing device adjustment control, and effectively prevent the increase in density of solid images and the like and fogging. It is also possible to restrain the decrease in throughput of the printer.

The present invention is not limited to the above embodiments and various changes and modifications can be made within the spirit and scope of the present invention. Therefore, to apprise the public of the scope of the present invention, the following claims are made.

What is claimed is:

1. An image forming apparatus having an image carrier, and a developing unit for forming an image by supplying a developer onto the image carrier, the apparatus comprising:

a consumption amount detecting unit configured to detect an amount of consumed developer in a case where an amount of image formation using the developing unit has reached a predetermined amount;

a control unit configured to transfer an image formed on the image carrier onto a transfer material, or to perform an adjustment operation of adhering the developer to the image carrier so as to consume the developer without transferring an image on the transfer material; and a setting unit configured to set an amount of the developer consumed in the adjustment operation on the basis of the amount of consumed developer detected by said consumption amount detecting unit, wherein said control unit performs the adjustment operation based on the amount of the developer set by said setting unit.

2. The apparatus according to claim 1, wherein said setting unit sets the amount of the developer consumed in the adjustment operation on the basis of the amount of the consumed developer detected by said consumption amount detecting unit and a predetermined threshold value.

3. The apparatus according to claim 2, wherein the predetermined threshold value corresponds to a characteristic of the developer.

4. The apparatus according to claim 1, wherein said setting unit sets the amount of the developer consumed in the adjustment operation in accordance with an environment in which the developing unit operates.

5. The apparatus according to claim 1, wherein said setting unit sets the amount of the developer consumed in the adjustment operation in accordance with conditions in which the developing unit operates.

6. The apparatus according to claim 1, wherein said setting unit sets the amount of the developer consumed in the adjustment operation with respect to a color of the developer.

7. An image forming apparatus having an image carrier, and a developing unit for forming an image by supplying a developer onto the image carrier, the apparatus comprising:

a consumption amount detecting unit configured to detect an amount of consumed developer in a case where an amount of image formation using the developing unit has reached a predetermined amount;

a control unit configured to transfer an image formed on the image carrier onto a transfer material, or to perform an adjustment operation of driving the developing unit without supplying the developer to the image carrier; and a setting unit configured to set a driving time period of the developing unit in the adjustment operation on the basis of the amount of consumed developer detected by said consumption amount detecting unit, wherein said control unit performs the adjustment operation based on the driving time period of the developing unit set by said setting unit.

8. The apparatus according to claim 7, wherein said setting unit sets the driving time period of the developing unit in the adjustment operation on the basis of the amount of the consumed developer detected by said consumption amount detecting unit and a predetermined threshold value.

9. The apparatus according to claim 7, wherein the predetermined threshold value corresponds to a characteristic of the developer.

10. The apparatus according to claim 7, wherein said setting unit sets the driving time period of the developing unit in accordance with an environment in which the developing unit operates.

11. The apparatus according to claim 7, wherein said setting unit sets the driving time period of the developing unit in accordance with conditions in which the developing unit operates.

12. The apparatus according to claim 7, wherein said setting unit sets the driving time period of the developing unit in accordance with a color of the developer.

13. The apparatus according to claim 7, wherein the developing unit comprises a developer carrier which supplies the developer onto the image carrier, and said control unit drives the developer carrier.

14. A method of adjusting a developing unit in an image forming apparatus having an image carrier, and the developing unit for forming an image by supplying a developer onto the image carrier, the method comprising:

a consumption amount detection step of detecting an amount of consumed developer in a case where an amount of image formation using the developing unit has reached a predetermined amount;

a control step of transferring an image formed on the image carrier onto a transfer material, or performing an adjustment operation of adhering the developer to the image carrier so as to consume the developer without transferring an image on the transfer material; and a setting step of setting an amount of the developer consumed in the adjustment operation on the basis of the amount of consumed developer detected in said consumption amount detecting step.

15. The method according to claim 14, wherein in said setting step, the amount of the developer consumed in the adjustment operation is set in accordance with an environment in which the developing unit operates.

16. The method according to claim 14, wherein in said setting step, the amount of the developer consumed in the adjustment operation is set in accordance with conditions in which the developing unit operates.

17. The method according to claim 14, wherein in said setting step, the amount of the developer consumed in the adjustment operation is set in accordance with a color of the developer.

18. A method of adjusting a developing unit in an image forming apparatus having an image carrier, and the developing unit for forming an image by supplying a developer onto the image carrier, the method comprising:

a consumption amount detection step of detecting an amount of consumed developer in a case where an amount of image formation using the developing unit has reached a predetermined amount;

a control step of transferring an image formed on the image carrier onto a transfer material, or performing an adjustment operation of driving the developing unit without supplying the developer to the image carrier; and a setting step of setting a driving time period of the developing unit in the adjustment operation on the basis of the amount of consumed developer detected in said consumption amount detecting step.

19. The method according to claim 18, wherein in said setting step, the driving time period of the developing unit is set in accordance with an environment in which the developing unit operates.

20. The method according to claim 18, wherein in said setting step, the driving time period of the developing unit is set in accordance with conditions in which the developing unit operates.

21. The method according to claim 18, wherein in said setting step, the driving time period of the developing unit is set in accordance with a color of the developer.

22. A developing unit detachable from an image forming apparatus, comprising a vessel containing a developer and a storage medium for storing information, wherein the information is used to control an adjustment operation in which the image forming apparatus consumes the developer without transferring an image onto a transfer material.

23. The unit according to claim 22, wherein in the adjustment operation, a predetermined amount of the developer is adhered onto an image carrier on the basis of an amount of consumed developer detected by a consumption amount detecting unit in a main body of the image forming apparatus and the information stored in said storage medium.

24. A developing unit detachable from an image forming apparatus, comprising a vessel containing a developer and a storage medium for storing information, wherein the information is used to control an adjustment operation in which the image forming apparatus drives the developing unit without supplying the developer to an image carrier.

25. A storage medium provided in a developing unit usable with an image forming apparatus, the developing unit having a vessel containing a developer, the medium comprising:

a storage area for storing information concerning a characteristic of the developer, wherein the information is to control an adjustment operation in which the image forming apparatus consumes the developer without transferring an image onto a transfer material.

26. The medium according to claim 25, wherein in the adjustment operation, a predetermined amount of the developer is adhered onto an image carrier on the basis of an amount of consumed developer detected by a consumption amount detecting unit in a main body of the image forming apparatus and the information stored in said storage area.

27. A storage medium provided in a developing unit usable with an image forming apparatus, the developing unit having a vessel containing a developer, the medium comprising:

a storage area for storing information concerning to a characteristic of the developer, wherein the information is to control an adjustment operation in which the image forming apparatus drives the developing unit without supplying the developer to an image carrier.

* * * * *

UNITED STATES PATENT AND TRADEMARK OFFICE

CERTIFICATE OF CORRECTION

PATENT NO. : 7,162,167 B2
APPLICATION NO. : 10/807319
DATED : January 9, 2007
INVENTOR(S) : Kenichi Iida et al.

It is certified that error appears in the above-identified patent and that said Letters Patent is hereby corrected as shown below:

COLUMN 7:
Line 5, “b” should be deleted.

COLUMN 8:
Line 13, “flow chart” should read --flowchart--.

COLUMN 9:
Line 50, “lines” should read --line--; and “increases changes” should read --and/or increases changes--.

COLUMN 10:
Line 32, “adjusting” should read --adjusted--.
Line 37, “adjusting” should read --adjusted--.
Line 39, “adjusting” should read --adjusted--.
Line 54, “4.05.[mg].” should read --4.05 [mg].--.

COLUMN 11:
Line 2, “adjusting” should read --adjusted--.

COLUMN 15:
Line 30, “during” should read --when--.

COLUMN 16:
Line 5, “prevent,” should read --prevent--.

COLUMN 19:
Line 42, “Y tone” should read --Y toner--.

UNITED STATES PATENT AND TRADEMARK OFFICE

CERTIFICATE OF CORRECTION

PATENT NO. : 7,162,167 B2
APPLICATION NO. : 10/807319
DATED : January 9, 2007
INVENTOR(S) : Kenichi Iida et al.

It is certified that error appears in the above-identified patent and that said Letters Patent is hereby corrected as shown below:

COLUMN 21:
Line 1, "each" should read --each of--.
Line 61, "magnetooptical" should read --magneto-optical--.
Line 64, "are" should be deleted.

Signed and Sealed this

Seventeenth Day of July, 2007

JON W. DUDAS
*Director of the United States Patent and Trademark Office*